US011404229B2

(12) United States Patent
Singh et al.

(10) Patent No.: US 11,404,229 B2
(45) Date of Patent: Aug. 2, 2022

(54) FLAT WALL SWITCH ASSEMBLY

(71) Applicant: HONEYWELL INTERNATIONAL INC., Morris Plains, NJ (US)

(72) Inventors: Dilip Singh, Morris Plains, NJ (US); Arvind Kumar, Morris Plains, NJ (US); Varun Pandey, Morris Plains, NJ (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 36 days.

(21) Appl. No.: 16/844,005

(22) Filed: Apr. 9, 2020

(65) Prior Publication Data

US 2020/0328052 A1 Oct. 15, 2020

(51) Int. Cl.

| | |
|---|---|
| ***H01H 23/14*** | (2006.01) |
| ***H01H 23/20*** | (2006.01) |
| ***H01H 23/30*** | (2006.01) |
| *H01H 23/06* | (2006.01) |

(52) U.S. Cl.

CPC ..... *H01H 23/143* (2013.01); *H01H 23/205* (2013.01); *H01H 23/30* (2013.01); *H01H 23/06* (2013.01)

(58) Field of Classification Search

CPC ..... H01H 23/145; H01H 23/16; H01H 19/14; H01H 23/14; H01H 23/24; H01H 23/02; H01H 2221/016; H01H 23/143; H01H 23/003; H01H 23/30; H01H 23/00; H01H 23/025; H01H 2300/03; H01H 23/04; H01H 23/168; H01H 2221/018; H01H 23/12; H01H 23/146; H01H 23/20; H01H 23/28; H01H 23/148; H01H 23/26

See application file for complete search history.

(56) References Cited

U.S. PATENT DOCUMENTS

| | | | | |
|---|---|---|---|---|
| 3,772,484 | A * | 11/1973 | Roeser | H01H 23/16 200/4 |
| 4,757,164 | A | 7/1988 | Bauer et al. | |
| 5,207,317 | A | 5/1993 | Bryde et al. | |
| 5,500,498 | A | 3/1996 | Kurek et al. | |
| 7,122,754 | B2 | 10/2006 | Endres et al. | |
| 7,126,070 | B2 | 10/2006 | Endres et al. | |

(Continued)

FOREIGN PATENT DOCUMENTS

| | | |
|---|---|---|
| EP | 0307364 A2 | 3/1989 |
| EP | 2672498 A1 | 12/2013 |

OTHER PUBLICATIONS

EP20168098, Extended European Search Report, p. 12, dated Sep. 4, 2020.

(Continued)

*Primary Examiner* — Ahmed M Saeed

(74) *Attorney, Agent, or Firm* — Seager, Tufte & Wickhem, LLP

(57) ABSTRACT

A switch having a push panel, a rocker, and a rocker actuator that actuates the rocker each time the push panel is pushed by a user. The switch includes a conductive switch member, that is toggled by the rocker, to connect and disconnect a first terminal from a second terminal. The switch is constructed to help reduce dust and debris from entering into the wall switch, and the switch may provide a visual cue to indicate a current ON/OFF state of the switch.

19 Claims, 12 Drawing Sheets

(56) References Cited

U.S. PATENT DOCUMENTS

| | | | |
|---|---|---|---|
| 7,439,832 | B1 | 10/2008 | Radosavljevic et al. |
| 7,700,888 | B2 | 4/2010 | Kurek et al. |
| 8,853,893 | B2 | 10/2014 | Savicki, Jr. et al. |
| 8,946,576 | B2 | 2/2015 | Savicki, Jr. et al. |
| 8,963,035 | B2 | 2/2015 | Weisburgh |
| 9,035,204 | B2 | 5/2015 | Czarnecki |
| 2003/0121765 | A1 | 7/2003 | Savicki, Jr. et al. |
| 2005/0077163 | A1 | 4/2005 | Adams et al. |
| 2006/0131152 | A1 | 6/2006 | Endres et al. |
| 2007/0095642 | A1 | 5/2007 | Endres et al. |
| 2008/0035459 | A1 | 2/2008 | Endres et al. |
| 2010/0101924 | A1 | 4/2010 | Wu et al. |
| 2011/0240445 | A1 | 10/2011 | Gottschalk et al. |
| 2012/0003885 | A9 | 1/2012 | Lindenstraus et al. |

OTHER PUBLICATIONS

"New Price List", Wipro Enterprises, Limited, Bangalore, India, pp. 1-32, Jun. 2016.
"Switches and Sockets", Schneider Electric, pp. 1-15, Sep. 2014.

* cited by examiner

FLAT WALL SWITCH ASSEMBLY

CROSS-REFERENCE TO RELATED APPLICATIONS

This specification is based upon and claims the benefit of priority from Indian patent application number IN 201911015062 filed on Apr. 15, 2019, the entire contents of which are incorporated herein by reference.

TECHNICAL FIELD

The disclosure relates generally to wall switches, and more particularly to flat wall switch assemblies.

BACKGROUND

Buildings and other structures often have wall-mounted switches to control lighting or other functions within a room. Such wall-mounted switches can take on a variety of forms. Currently, flat wall switches are available that include a push panel that is generally flat in the neutral position. The push panel is then pushed inward by a user to switch the switch between an ON position and an OFF position. Many of such flat wall switches, however, have relatively large gaps that allow dust and/or other debris to accumulate behind the push panel and sometimes into the switch mechanism itself. This can reduce the reliability of such flat wall switches over time. Moreover, in many flat wall switches, the push panel assumes an identical neutral position when the switch is in either the ON position and the OFF position. Thus, there are often no visual cues that indicate the current state of the flat wall switch. What would be desirable is a flat wall switch that is configured with built in barriers to help reduce dust and debris from entering into the wall switch. What would also be desirable is a flat wall switch that has a visual cue that indicates to the user a current state of the flat wall switch.

SUMMARY

This disclosure relates generally to flat wall switch assemblies. In one example, a switch may include a first terminal, a second terminal, a push panel configured to be pushed inward by a user from a REST position to an END STOP position against a push panel bias, and then return to the REST position under the push panel bias, and a rocker configured to rock between an ON position and an OFF position about a rotation axis. The switch may also include a rocker actuator configured to actuate the rocker alternately between the ON position and the OFF position each time the push panel is pushed from the REST position to the END STOP position, the rocker actuator is further configured to move in the inward direction when the push panel is pushed inward by the user from the REST position to the END STOP position, and a slidable part of the rocker actuator is also configured to move in a direction lateral to the inward direction against a lateral bias member as the rocker is actuated between the ON position and the OFF position. The switch may further include a conductive switch member operatively coupled to the rocker and electrically coupled to the first terminal, wherein the rocker is configured to toggle the conductive switch member between a CLOSED position and an OPEN position, wherein the rocker moves the conductive switch member to the CLOSED position when the rocker is moved by the rocker actuator to the ON position of the rocker, and the rocker moves the conductive switch member to the OPEN position when the rocker is moved by the rocker actuator to the OFF position of the rocker. In the CLOSED position, the conductive switch member connects the first terminal to the second terminal, and in the OPEN position, the conductive switch member does not connect the first terminal to the second terminal.

It is contemplated that the push panel bias may be provided by one or more springs, and the lateral bias member may include one or more springs.

Alternatively or additionally to any of the embodiments above, the slidable part of the rocker actuator may be configured to move in a first lateral direction from a NEUTRAL position against the lateral bias member as the rocker is actuated from the ON position to the OFF position, and to move in a second opposing lateral direction from the NEUTRAL position against the lateral bias member as the rocker is actuated from the OFF position to the ON position.

Alternatively or additionally to any of the embodiments above, the lateral bias member may be configured to return the slidable part of the rocker actuator to the NEUTRAL position each time the push panel returns to the REST position under the push panel bias.

Alternatively or additionally to any of the embodiments above, further including a rocker flag positioned behind the push panel, wherein the rocker is configured to move the rocker flag between a VISIBLE position and a NON-VISIBLE position, wherein the push panel includes an aperture that is positioned such that the rocker flag is visible through the aperture when the rocker flag is in the VISIBLE position and the rocker flag is not visible through the aperture when the rocker flag is in the NON-VISIBLE position.

Alternatively or additionally to any of the embodiments above, the slidable part of the rocker actuator may include a first push feature and a second push feature, and the rocker may include a first receiving feature and a second receiving feature. Additionally, when the rocker is in the ON position, and the push panel is pushed inward by the user from the REST position to the END STOP position, the first push feature of the slidable part of the rocker actuator engages and pushes the first receiving feature of the rocker inward, which rocks the rocker from the ON position to the OFF position about the rotation axis with the first push feature moving with the first receiving feature in both the inward direction and in a first direction lateral to the inward direction as the first receiving feature travels along an arc in a first rotation direction about the rotation axis, while the rocker moves the conductive switch member from the CLOSED position to the OPEN position. Moreover, when the rocker is in the OFF position, and the push panel is pushed inward by the user from the REST position to the END STOP position, the second push feature of the slidable part of the rocker actuator engages and pushes the second receiving feature of the rocker inward, which rocks the rocker from the OFF position to the ON position about the rotation axis with the second push feature moving with the second receiving feature in both the inward direction and in a second direction lateral to the inward direction as the second receiving feature travels along an arc in a second rotation direction about the rotation axis, while the rocker moves the conductive switch member from the OPEN position to the CLOSED position.

Alternatively or additionally to any of the embodiments above, the rocker may include a plunger that includes a switch member bias element. Additionally, the conductive switch member may include a control region and a contact region, wherein the control region is operatively coupled between a plunger of the rocker and a switch member support, wherein the switch member support is electrically coupled to the first terminal. Moreover, when the conductive switch member is in the CLOSED position, the contact region of the conductive switch member electrically connects to the second terminal, and when the conductive switch member is in the OPEN position, the contact region of the conductive switch member does not electrically connect to the second terminal.

Alternatively or additionally to any of the embodiments above, the plunger may provide a larger bias force to the control region of the conductive switch member against the switch member support when the conductive switch member is between the CLOSED position and the OPEN position relative to when the conductive switch member is at the CLOSED position or the OPEN position.

In another example, a switch may include a first terminal, a second terminal, a push panel configured to be pushed inward by a user from a REST position to an END STOP position against a push panel bias, and then return to the REST position under the push panel bias, a rocker configured to rock between an ON position and an OFF position, a rocker actuator configured to actuate the rocker alternately between the ON position and the OFF position each time the push panel is pushed from the REST position to the END STOP position, and the rocker may include a switch member bias element. The switch may also include a conductive switch member including a control region and a contact region, wherein the control region is operatively coupled between the switch member bias element of the rocker and a switch member support, wherein the switch member support is electrically coupled to the first terminal. Additionally, the rocker may be configured to toggle the conductive switch member between a CLOSED position and an OPEN position, wherein the rocker moves the conductive switch member to the CLOSED position when the rocker is moved by the rocker actuator to the ON position of the rocker, and the rocker moves the conductive switch member to the OPEN position when the rocker is moved by the rocker actuator to the OFF position of the rocker, wherein when the conductive switch member is in the CLOSED position, the contact region of the conductive switch member electrically connects to the second terminal, and when the conductive switch member is in the OPEN position, the contact region of the conductive switch member does not electrically connect to the second terminal.

Alternatively or additionally to any of the embodiments above, the switch member bias element of the rocker may include a plunger that engages the control region of the conductive switch member.

Alternatively or additionally to any of the embodiments above, the switch member bias element may provide a larger bias force to the control region of the conductive switch member against the switch member support when the conductive switch member is between the CLOSED position and the OPEN position relative to when the conductive switch member is at the CLOSED position or the OPEN position.

Alternatively or additionally to any of the embodiments above, the push panel bias may be provided by one or more springs.

Alternatively or additionally to any of the embodiments above, further including a rocker flag positioned behind the push panel, wherein the rocker is configured to move the rocker flag between a VISIBLE position and a NON-VISIBLE position, wherein the push panel includes an aperture that is positioned such that the rocker flag is visible through the aperture when the rocker flag is in the VISIBLE position and the rocker flag is not visible through the aperture when the rocker flag is in the NON-VISIBLE position.

Alternatively or additionally to any of the embodiments above, further including a third terminal and the conductive switch member includes a first contact region and a second contact region, wherein when the conductive switch member is in the CLOSED position, the first contact region of the conductive switch member electrically connects to the second terminal and the second contact region of the conductive switch member does not electrically connect to the third terminal, and when the conductive switch member is in the OPEN position, the first contact region of the conductive switch member does not electrically connect to the second terminal and the second contact region of the conductive switch member electrically connect to the third terminal.

Alternatively or additionally to any of the embodiments above, the switch member support may include a recess for receiving a first side of the control region of the conductive switch member, and the plunger includes a recess for receiving a second side of the control region of the conductive switch member, such that the control region of the conductive switch member pivots about the recess in the switch member support as the rocker toggles the conductive switch member between the CLOSED position and the OPEN position.

Alternatively or additionally to any of the embodiments above, the second terminal may face toward the push panel and the contact region may extend away from the control region and is configured to reach over and engage the second terminal when the conductive switch member is in the CLOSED position.

Alternatively or additionally to any of the embodiments above, the contact region may lift away from the second terminal in a direction toward the push panel when the conductive switch member is moved from the CLOSED position to the OPEN position.

In another example, a switch may include a first terminal, a second terminal, a third terminal, a push panel configured to be pushed inward by a user from a REST position to an END STOP position against a push panel bias, and then return to the REST position under the push panel bias, a rocker configured to rock between an FIRST position and a SECOND position and a rocker actuator configured to actuate the rocker alternately between the FIRST position and the SECOND position each time the push panel is pushed from the REST position to the END STOP position. The switch may also include a conductive switch member operatively coupled to the rocker and electrically coupled to the first terminal, wherein the rocker is configured to toggle the conductive switch member between a FIRST position and a SECOND position, wherein the rocker moves the conductive switch member to the FIRST position when the rocker is moved by the rocker actuator to the FIRST position of the rocker, and the rocker moves the conductive switch member to the SECOND position when the rocker is moved by the rocker actuator to the SECOND position of the rocker. Additionally, in the FIRST position, the conductive switch member connects the first terminal to the second terminal, and in the SECOND position, the conductive switch member connects the first terminal to the third terminal.

Alternatively or additionally to any of the embodiments above, the conductive switch member may include a first contact region and a second contact region, wherein in the FIRST position, the first contact region electrically engages the second terminal, and in the SECOND position, the second contact region electrically engages the third terminal.

Alternatively or additionally to any of the embodiments above, the first contact region may lift away from the second terminal in a direction toward the push panel when the conductive switch member is moved from the FIRST position to the SECOND position, and the second contact region may lift away from the third terminal in a direction toward the push panel when the conductive switch member is moved from the SECOND position to the FIRST position.

The above summary of some illustrative embodiments is not intended to describe each disclosed embodiment or every implementation of the present disclosure. The Figures and Description which follow more particularly exemplify these and other illustrative embodiments.

BRIEF DESCRIPTION OF THE FIGURES

The disclosure may be more completely understood in consideration of the following description in connection with the accompanying drawings, in which.

Figure 1A:
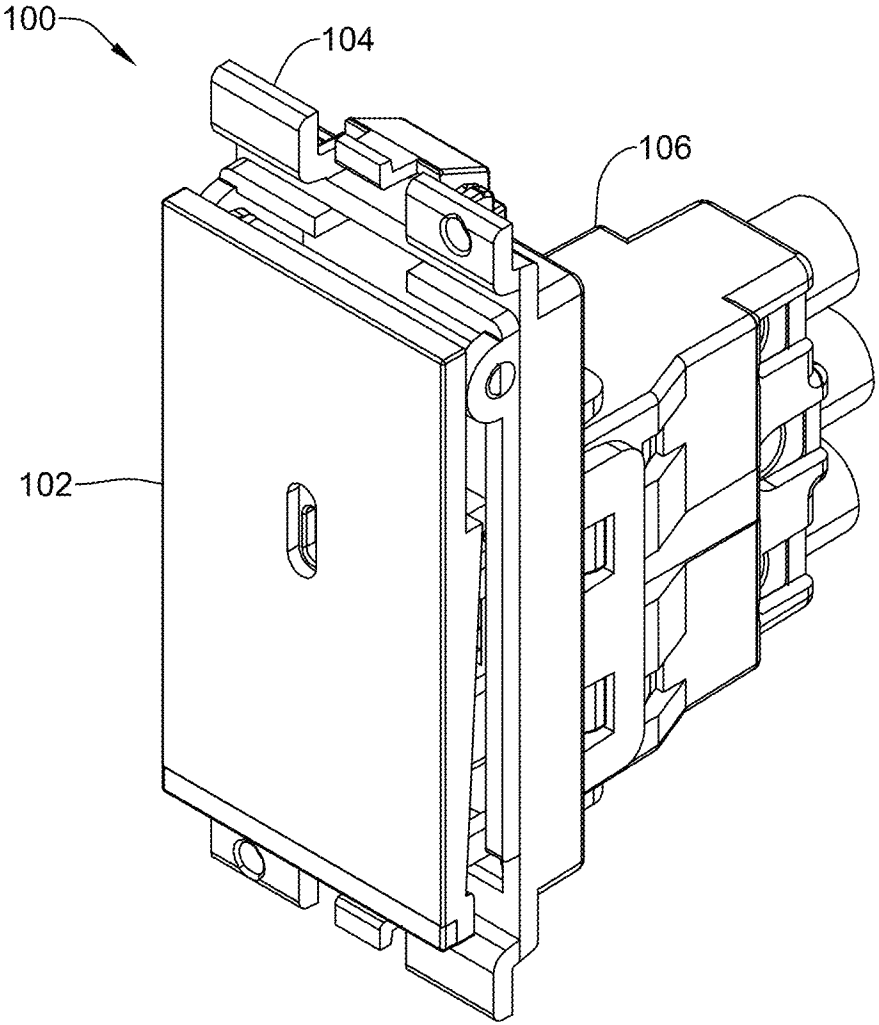
FIG. 1A is a perspective view of an illustrative wall switch.

While the disclosure is amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DESCRIPTION

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

The recitation of numerical ranges by endpoints includes all numbers within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment described may include one or more particular features, structures, and/or characteristics. However, such recitations do not necessarily mean that all embodiments include the particular features, structures, and/or characteristics. Additionally, when particular features, structures, and/or characteristics are described in connection with one embodiment, it should be understood that such features, structures, and/or characteristics may also be used connection with other embodiments whether or not explicitly described unless clearly stated to the contrary.

The following description should be read with reference to the drawings in which similar structures in different drawings are numbered the same. The drawings, which are not necessarily to scale, depict illustrative embodiments and are not intended to limit the scope of the disclosure.

FIG. 1A depicts a perspective view of an illustrative wall switch 100. In the example shown, the wall switch 100 includes a push panel 102, a switching mechanism 104, and a terminal housing 106. In some instances, the switching mechanism 104 may include mounting features that are used to mount the wall switch 100 to a building or structure, such as a junction box in a wall of the a building or structure. In some cases, when wall switch 100 is mounted and installed in a junction box, the push panel 102 may be configured to lie in a plane that is substantially parallel to the wall. In some cases, the push panel 102 may be configured to be relatively flat when in both in the ON and OFF state. However, the push panel 102 may be hinged at the top, which may help prevent dust and other debris from settling in behind the push panel. It is to be appreciated that the wall switch 100 can be any size and/or shape and is not limited to the depicted illustrations.

Figure 1B:
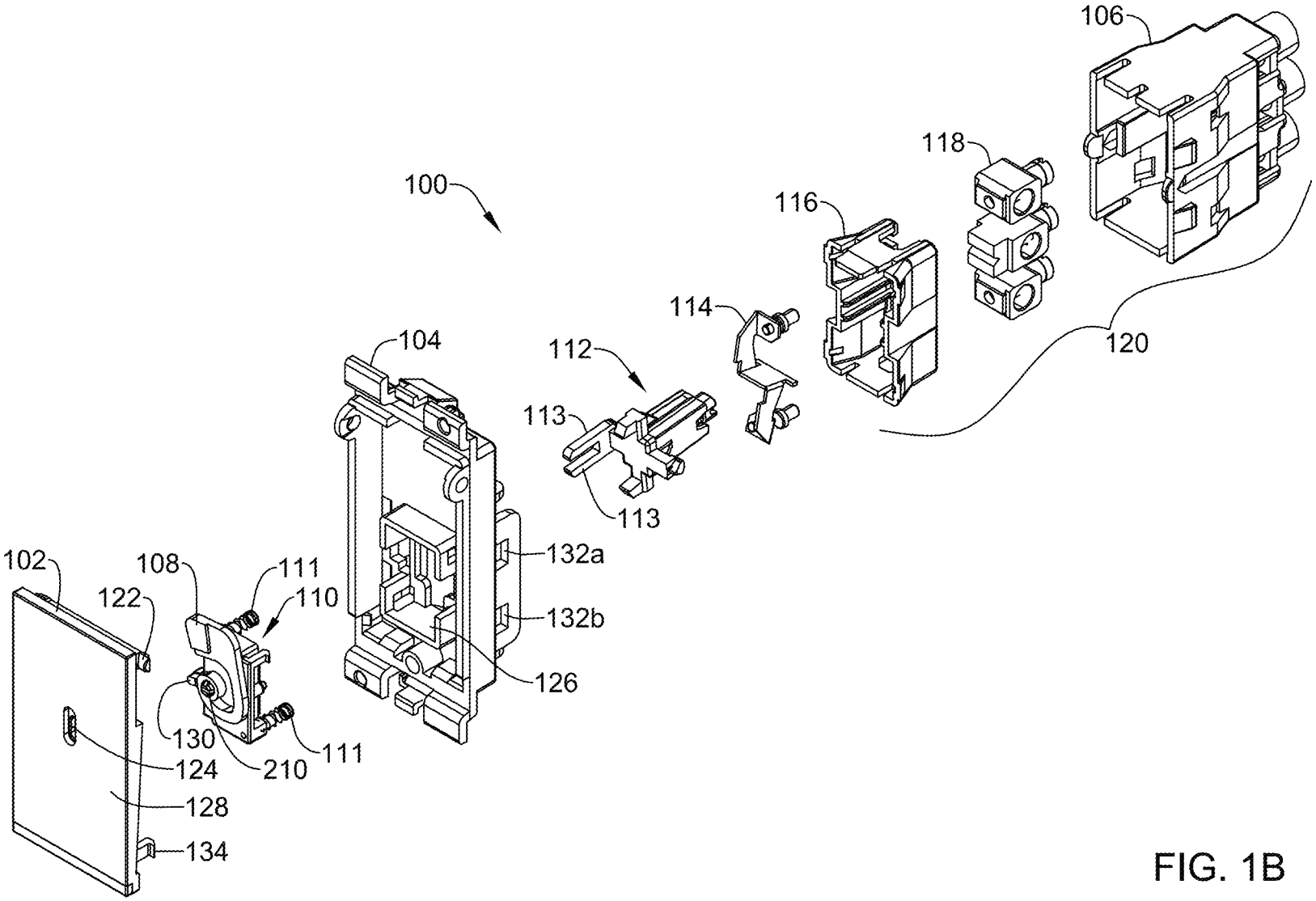
FIG. 1B is an exploded view of the illustrative wall switch of FIG. 1A.

FIG. 1B depicts an exploded view of the illustrative wall switch 100 of FIG. 1A. As shown, in some cases, the wall switch 100 may include the push panel 102 and a terminal housing 106. When the push panel 102 is pushed inward by user, the illustrative wall switch 100 switches alternatively between an ON state and an OFF state. In the ON state, two of the terminals of the terminal housing 106 are electrically connected, and in the OFF state, the two or more terminals are electrically disconnected. Each time the push panel 102 is pushed by the user, the illustrative wall switch 100 switches state.

FIG. 1B is an exploded view of the illustrative wall switch of FIG. 1A. As can be seen, the illustrative wall switch 100 includes a push panel 102, a rocker actuator 110, a rocker 112, a rocker flag 108 coupled to the rocker actuator, a conductive switch member 114, and a terminal assembly 120. In some cases, the terminal assembly 120 may include electrical terminals 118 encased or enclosed by a terminal housing 106 when the wall switch 100 is in the assembled configuration. A rack 116 may be situated about part of the electrical terminals 118 as shown.

In some instances, the push panel 102 may include a hinge 122 and a return stop 134. In some examples, the hinge 122 may operate as a pivot point that allows the push panel 128 to pivot inward from a REST position to an END STOP position. An end stop (not explicitly shown) may be provided to stop the push panel 128 from pivoting past the END STOP position. A return stop 134 may prevent the push panel 128 from pivoting in the other direction past the REST position.

The rocker actuator 110 may actuate the rocker 112 alternately between the ON position and the OFF position each time the push panel 102 is pushed from the REST position to the END STOP position. In some cases, the free end of the rocker actuator 110 may move in the inward direction when the push panel is pushed inward by the user from the REST position to the END STOP position, and a slidable part of the rocker actuator (see FIG. 2C) may move in a direction lateral to the inward direction against a lateral bias member as the rocker 112 is actuated between the ON position and the OFF position. The conductive switch member 114 is operatively coupled to the rocker 112 and electrically coupled to a first terminal of electrical terminals 118. The rocker 112 is configured to toggle the conductive switch member 114 between a CLOSED position and an OPEN position, wherein the rocker 112 moves the conductive switch member 114 to the CLOSED position when the rocker 112 is moved by the rocker actuator 110 to the ON position of the rocker 112, and the rocker 112 moves the conductive switch member 114 to the OPEN position when the rocker 112 is moved by the rocker actuator 110 to the OFF position of the rocker 112. In the CLOSED position, the conductive switch member 114 connects the first terminal to a second terminal of the electrical terminals 118, and in the OPEN position, the conductive switch member 114 does not connect the first terminal to the second terminal.

In some cases, the push panel 102 may include an aperture 124 or a hole. The rocker flag 108, which may be a different color from the push panel 102, may be moved by the rocker 112 between an ON state and an OFF state. In the ON state, the rocker flag 108 may be moved behind the aperture 124 in the push panel 102 to be visible through the aperture 124. In the OFF state, the rocker flag 108 may be moved to the side of aperture 124 in the push panel 102 to not be visible through the aperture 124. This may provide a visual cue to the user to indicate the current state of the wall switch (ON or OFF). In some cases, the rocker flag 108 may include an appendage 130 that may interact with fork mechanism 113 of rocker 112, such that as the rocker 112 moves between the ON and OFF positions, the rocker flag 108 pivots about rocker flag securing mechanism 210 to pivot between the visible position and the not visible position.

The switching mechanism 104 may include indentations 132*a* and 132*b* to help secure the switching mechanism 104 to the terminal housing 106.

Figure 2A:
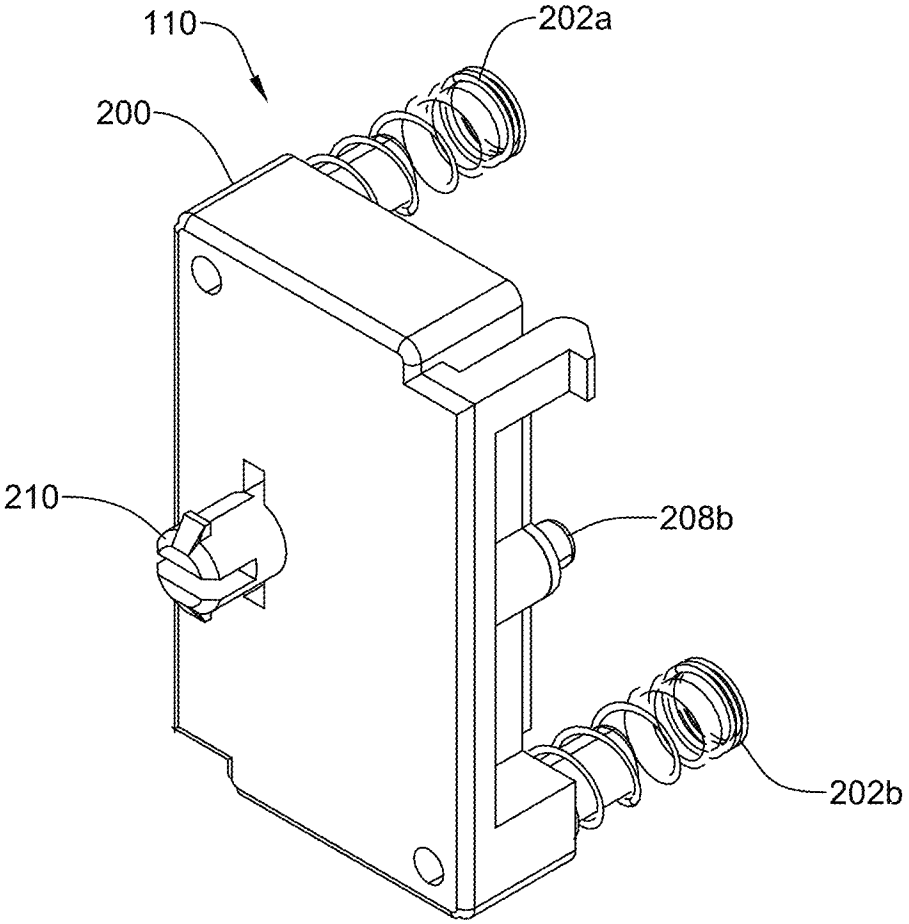
FIG. 2A is a perspective top view of an illustrative rocker actuator of the illustrative wall switch of FIGS. 1A-1B.
Figure 2B:
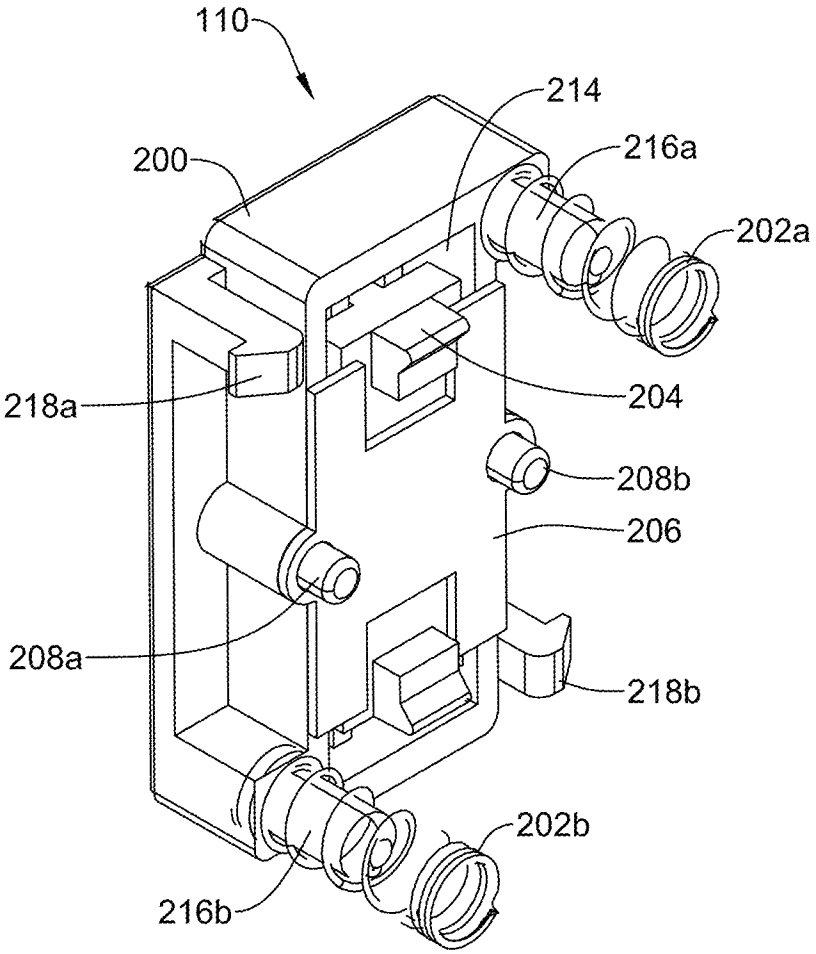
FIG. 2B is a perspective bottom view of the illustrative rocker actuator of FIG. 2A.

FIG. 2A is a perspective top view of the illustrative rocker actuator 110 of the illustrative wall switch of FIGS. 1A-1B. FIG. 2B is a perspective bottom view of the illustrative rocker actuator 110 of FIG. 2A, and FIG. 2C is an exploded view of the illustrative rocker actuator 110 of FIG. 2B.

In some cases, the rocker actuator 110 includes a housing 200, springs 202*a* and 202*b*, a slideable part 204, a bottom cover 206, and a rocker flag securing mechanism 210. In some cases, the rocker flag securing mechanism 210 may be configured to couple the rocker flag 108 to the rocker actuator 110 such that the rocker flag 108 may rotate about the rocker flag securing mechanism 210 to allow the rocker flag 108 to be visible through the aperture 124 in certain configurations (e.g., when the rocker actuator 110 is in an ON position) and not visible through the aperture in other configurations (e.g., when the rocker actuator 110 is in an OFF position). In some instances, the housing 200 may include prongs 208*a* and 208*b* configured to couple the bottom cover 206 to the housing 200 and enclose the slideable part 204 and a lateral bias member 212 (shown in FIG. 2C) inside a cavity 214 of the housing 200. The housing 200 may also include prongs 216*a* and 216*b* configured to couple the springs 202*a* and 202*b* to the housing 200. Additionally, the housing 200 may include sliding members 218*a* and 218*b* configured to couple the housing 200 to the holding section 126 of the switching mechanism 104 and allow the rocker actuator 110 to slide inward when the push panel 102 is pushed by a user.

Figure 2C:
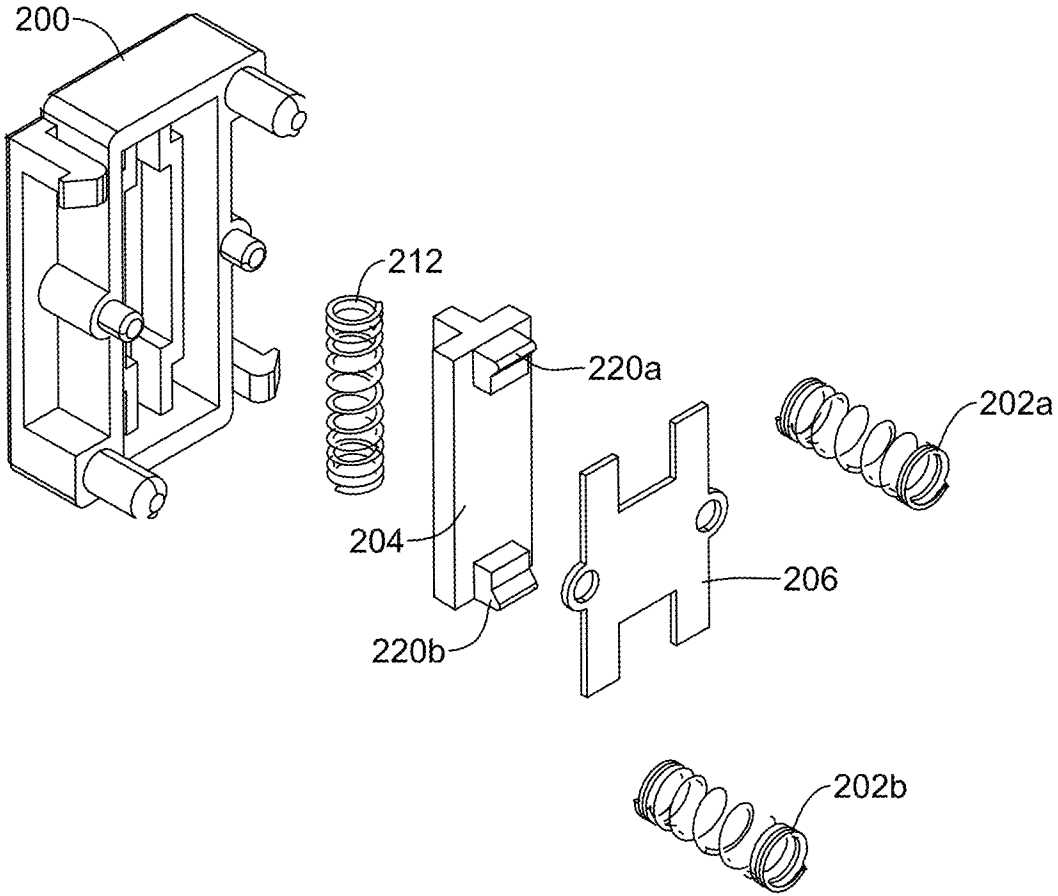
FIG. 2C is an exploded view of the illustrative rocker actuator of FIG. 2B.

FIG. 2C depicts an exploded view of the illustrative rocker actuator 110. As discussed above, the rocker actuator 110 may include the housing 200, the springs 202*a* and 202*b*, the slideable part 204, and the bottom cover 206. Additionally, the rocker actuator 110 may include the lateral bias member 212. In some examples, as shown, the lateral bias member 212 may include one or more springs. In some cases, when the push panel 102 is pushed by a user, the slideable part 204 may move from a neutral position in a first lateral direction. That is, in response to the inward movement of the rocker actuator 110, a first push feature 220*a* of the slideable part 204 may engage and push the rocker 112 inward and in the first lateral direction (about a rotation axis of the rocker 112), which causes the slideable part 204 to also move in the first lateral direction following the rocker 112. When the push panel 102 is released by the user, the lateral bias member 212 may be configured to move the slideable part 204 in a second, opposite direction, back to its neutral position. Also, the springs 202*a* and 202*b* may provide push panel bias that biases the push panel back towards its REST position.

Subsequently, when the push panel 102 is again pushed by the user, the slideable part 204 may move from the neutral position in the second lateral direction. That is, in response to the inward movement of the rocker actuator 110, a second push feature 220*b* of the slideable part 204 may engage and push the rocker 112 inward and in the second lateral direction (about the rotation axis of the rocker 112), which causes the slideable part 204 to also move in the second lateral direction following the rocker 112. When the push panel 102 is released again by the user, the lateral bias member 212 may be configured to move the slideable part 204 in the first, opposite direction, back to its neutral position.

Figure 3:
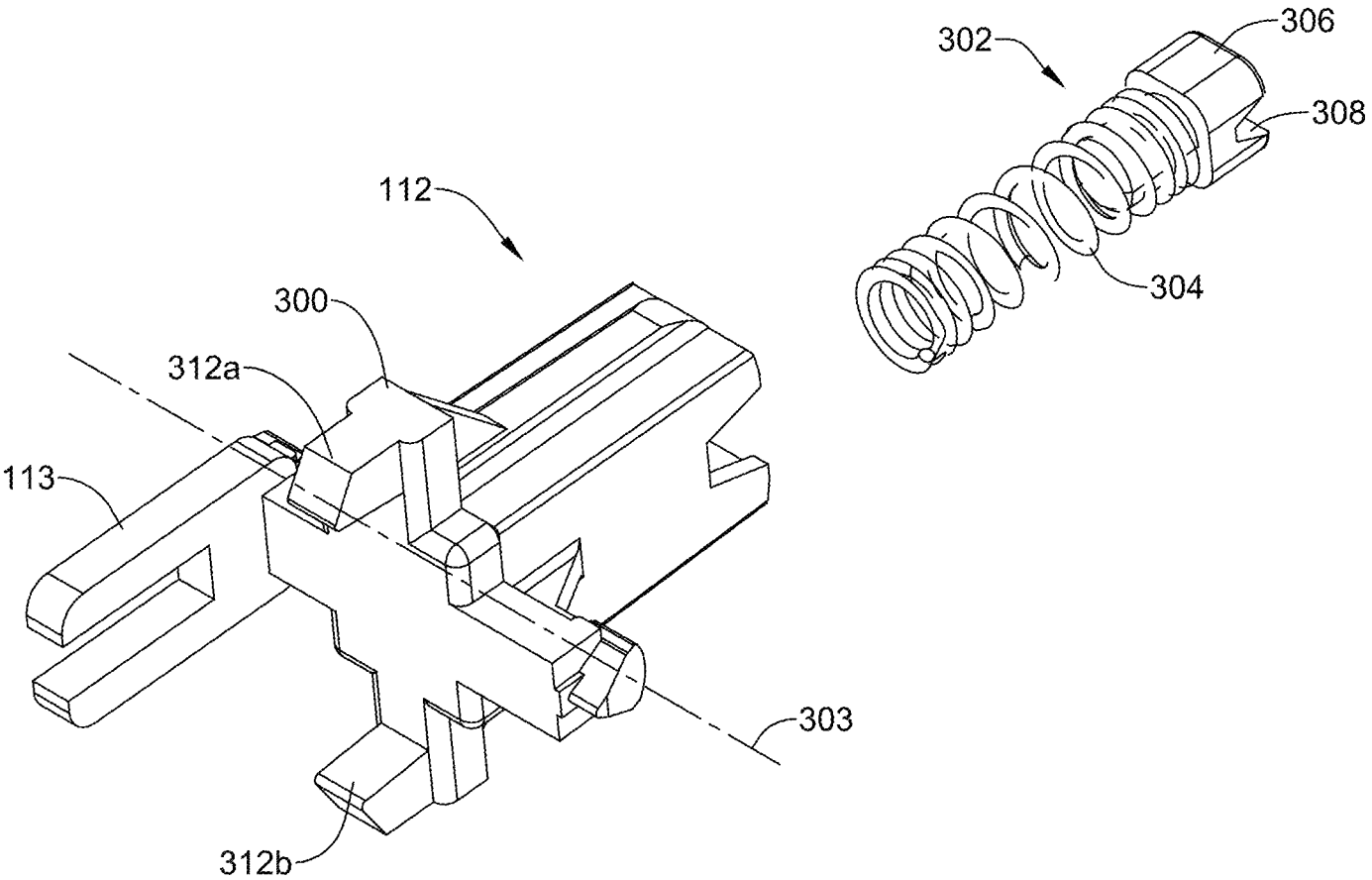
FIG. 3 is an exploded view of an illustrative rocker of the illustrative wall switch of FIGS. 1A-1B.

FIG. 3 is an exploded view of an illustrative rocker 112 of the illustrative wall switch of FIGS. 1A-1B. In some cases, the rocker 112 may include a rocker housing 300 configured to encase a plunger 302 that may be configured to engage and provide a bias to the conductive switch member 114. In some examples, when the push panel 102 is pushed by a user, the rocker actuator 110 may engage and push a first receiving feature 312*a* of the rocker housing 300 inward and in the first lateral direction, which may rock the rocker 112 from a first position to a second position about a rotation axis 303 as the first receiving feature 312*a* travels along an arc in a first rotation direction about the rotation axis 303. Additionally, when the push panel 102 is pushed again by the user, the rocker actuator 110 may engage and push a second receiving feature 312*b* of the rocker housing 300 inward and in the second lateral direction, which may rock the rocker 112 from the second position to the first position about the rotation axis 303 as the second receiving feature 312*b* travels along an arc in a second rotation direction about the rotation axis.

In some instances, the plunger 302 may include a switch member bias element 304 and a grappling mechanism 306. In some examples, the switch member bias element 304 may include a spring. In some examples, the grappling mechanism 306 may have a recess 308 for receiving an edge of the conductive switch member 114. In some instances, when the push panel 102 is pushed by a user, the rocker 112 pivots about its rotation axis 303, which forces the conductive switch member 114 between the CLOSED and OPEN positions, with the switch member bias element 304 providing a bias to the conductive switch member 114.

In some instances, the rocker housing 300 may include a fork mechanism 113 that may be configured to interact with the appendage 130 of the rocker flag 108. In some cases, when the push panel 102 is pushed by a user, the fork mechanism 113 may move laterally and shift the appendage 130. Accordingly, the shift in the appendage 130 may move the rocker flag 108 from a position such that the rocker flag 108 is visible through the aperture 124 in the push panel 102 to a position where the rocker flag 108 is not visible through the aperture 124, and vice versa. That is, if the rocker flag 108 is currently visible through the aperture 124, the shift in the appendage 130 may move the rocker flag 108 to not be visible through the aperture 124. Moreover, if the rocker flag 108 is currently not visible through the aperture 124, the shift in the appendage 130 may move the rocker flag 108 to be visible through the aperture 124.

Figure 4:
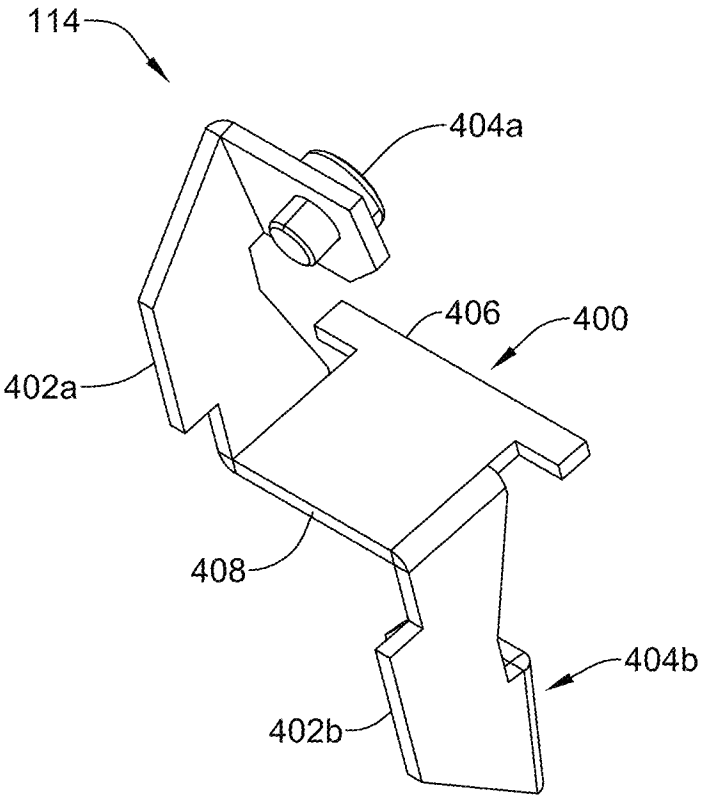
FIG. 4 is an exploded view of an illustrative conductive switch member of the illustrative wall switch of FIGS. 1A-1B.

FIG. 4 is an exploded view of an illustrative conductive switch member 114 of the illustrative wall switch of FIGS. 1A-1B. In some cases, the conductive switch member 114 may include a control region 400 and contact regions 402*a* and 402*b*. In some examples, some or all of the conductive switch member 114 may be constructed of metal or any other suitable electrically conductive material to facilitate the flow of electric current. In some instances, the contact region 402*a* may include an electrical contact 404*a* and contact region 402*b* may include an electrical contact 404*b*. In some cases, the control region 400 may include a first side 406 configured to be held in a recess of the electrical terminals 118. Additionally, the control region 400 may include a second side 408 configured to be held in the recess 308 of the grappling mechanism 306 of the rocker 112. As such, in some instances, the control region 400 may be operatively coupled between the rocker 112 and the electrical terminals 118. Moreover, when the push panel 102 is pushed by a user, the rocker 112 may force the control region 400 to pivot about the recess of the electrical terminals 118 as the rocker 112 toggles.

In some cases, when the conductive switch member 114 is in a first position, the electrical contact 402*b* of the contact region 402*b* may electrically connect to a second terminal of the electrical terminals 118, and when the conductive switch member is in an second position, the electrical contact 402*a* of the contact region 402*a* may electrically connect to a third terminal of the electrical terminals 118. In some cases, the control region remain in electrical contact with a first terminal of the electrical terminals 118.

Figure 5:
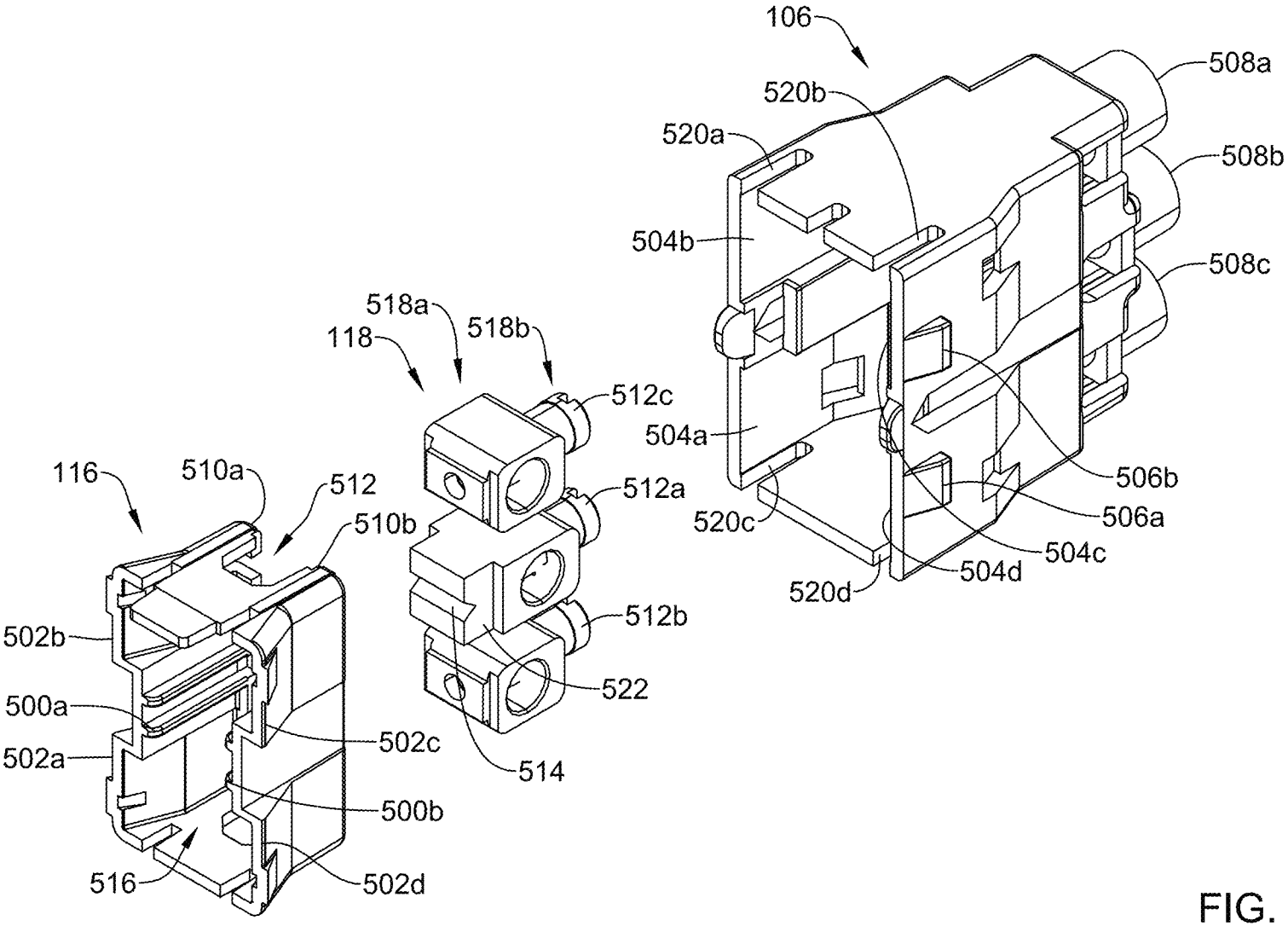
FIG. 5 is an exploded view of an illustrative terminal assembly of the illustrative wall switch of FIGS. 1A-1B.

FIG. 5 is an exploded view of an illustrative terminal assembly 120 of the illustrative wall switch of FIGS. 1A-1B. As stated above, the terminal assembly 120 may include the rack 116 and the electrical terminals 118 that may be encased or enclosed by the terminal housing 106 when the wall switch 100 is in the assembled configuration. In some cases, the rack 116 may include stoppers 500*a* and 500*b* that may be configured to stop the control region 400 of the conductive switch member 114 from pivoting out of the recess 514 of a switch member support 522 of the electrical terminals 118 when the rocker 112 toggles the conductive switch member 114. In some examples, the switch member support 522 may be electrically coupled to a first terminal 512*a* of the electrical terminals 118. In some instances, the rack 116 may include sliders 502*a*-502*d* for sliding into recesses 504*a*-504*d* of the terminal housing 106 and aligning the rack 116 inside the terminal housing 106.

In some examples, the terminal housing 106 may include protrusions 506*a* and 506*b* that may be received by the indentations 132*a* and 132*b* of the switching mechanism 104 and attach the terminal housing 106 to the switching mechanism 104. The terminal housing 106 may also include holes 508*a*-508*c* for allowing terminals 512*a*-512*c* of the electrical terminals 118 to electrical connect to electric wiring of the building or other structure. In some cases, the rack 116 may include an opening 512 for a lower portion 518*b* of the electrical terminals 118 to fit through. Additionally, resting mechanisms 510*a* and 510*b* of the rack 116 may stop an upper portion 518*a* from fitting through the opening 512 and hold the electrical terminals 118 in place such that the upper portion 518*a* of the electrical terminals 118 may reside in a cavity 516 of the rack 116.

In some cases, the recess 514 of the electrical terminals 118 may be configured to receive an edge of the control region of the conductive switch member 114. In some instances, when the push panel 102 is pushed by a user, the conductive switch member 114 pivots about the recess 514 between a first position and a second position, in response. In some cases, when the conductive switch member 114 is in the first position, the conductive switch member 114 may be connected to (i.e., in contact with) the second terminal 512*b* such that the conductive switch member 114 electrically connects the second terminal 512*b* to the first terminal 512*a*, and when the conductive switch member 114 is in the second position, the conductive switch member 114 may be connected to the third terminal 512*c* such that the conductive switch member 114 electrically connects the third terminal 512*c* to the first terminal 512*a*.

FIGS. 6A-6D depict an example operation of the wall switch 100 of FIGS. 1A-1B. FIGS. 6A-6D show a cut away side-view of the wall switch 100. Beginning at FIG. 6A, in this example, the wall switch 100 is in an ON position. Additionally, the push panel 102 is in the REST position, the rocker flag is in a VISIBLE position through the aperture 124, the slideable part 204 of the rocker actuator 110 is in a NEUTRAL position, the rocker 112 is in an ON position, and the conductive switch member 114 is in a CLOSED or first position such that the second terminal 512*b* faces toward the push panel 102 and the contact region 404*b* of the conductive switch member 114 extends away from the control region 400 and is configured to reach over and engage the second terminal 512*b*. As such, in the CLOSED position, the conductive switch member electrically connects the first terminal 512*a* to the second terminal 512*b*.

Figure 6A:
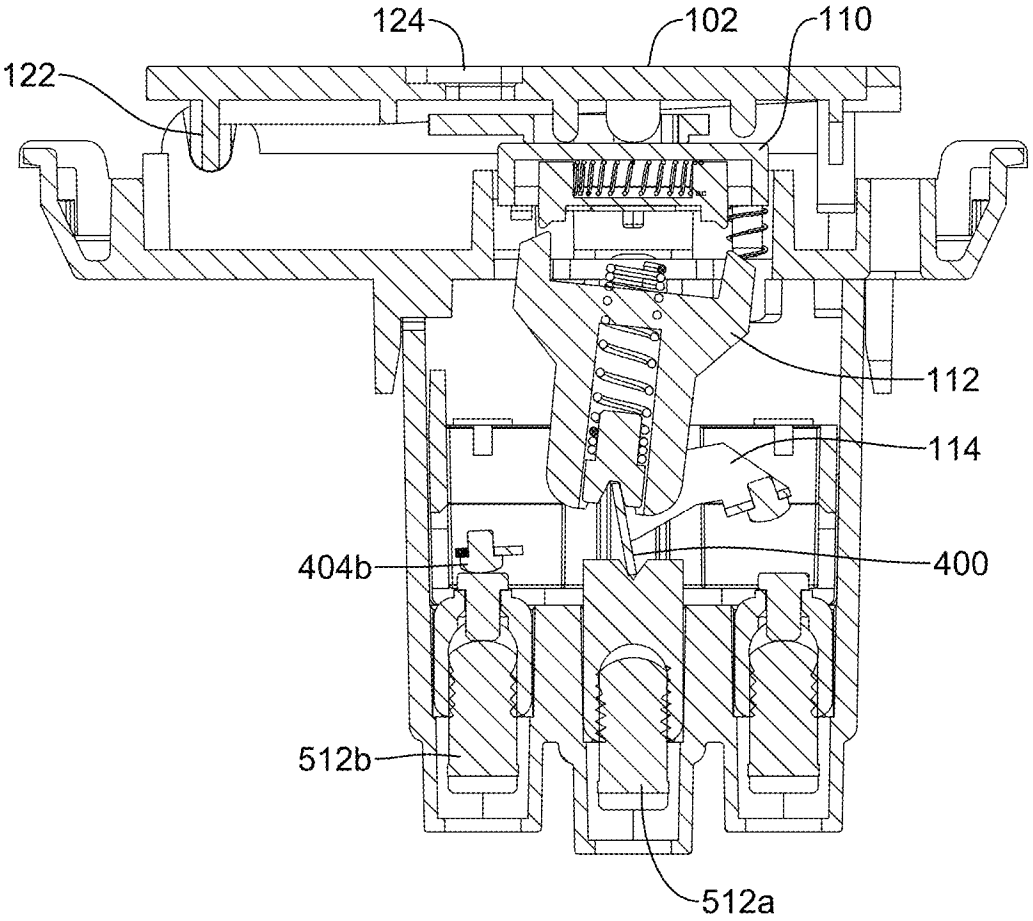
FIG. 6A-6D show an illustrative operation of the illustrative wall switch of FIGS. 1A-1B.
Figure 6B:
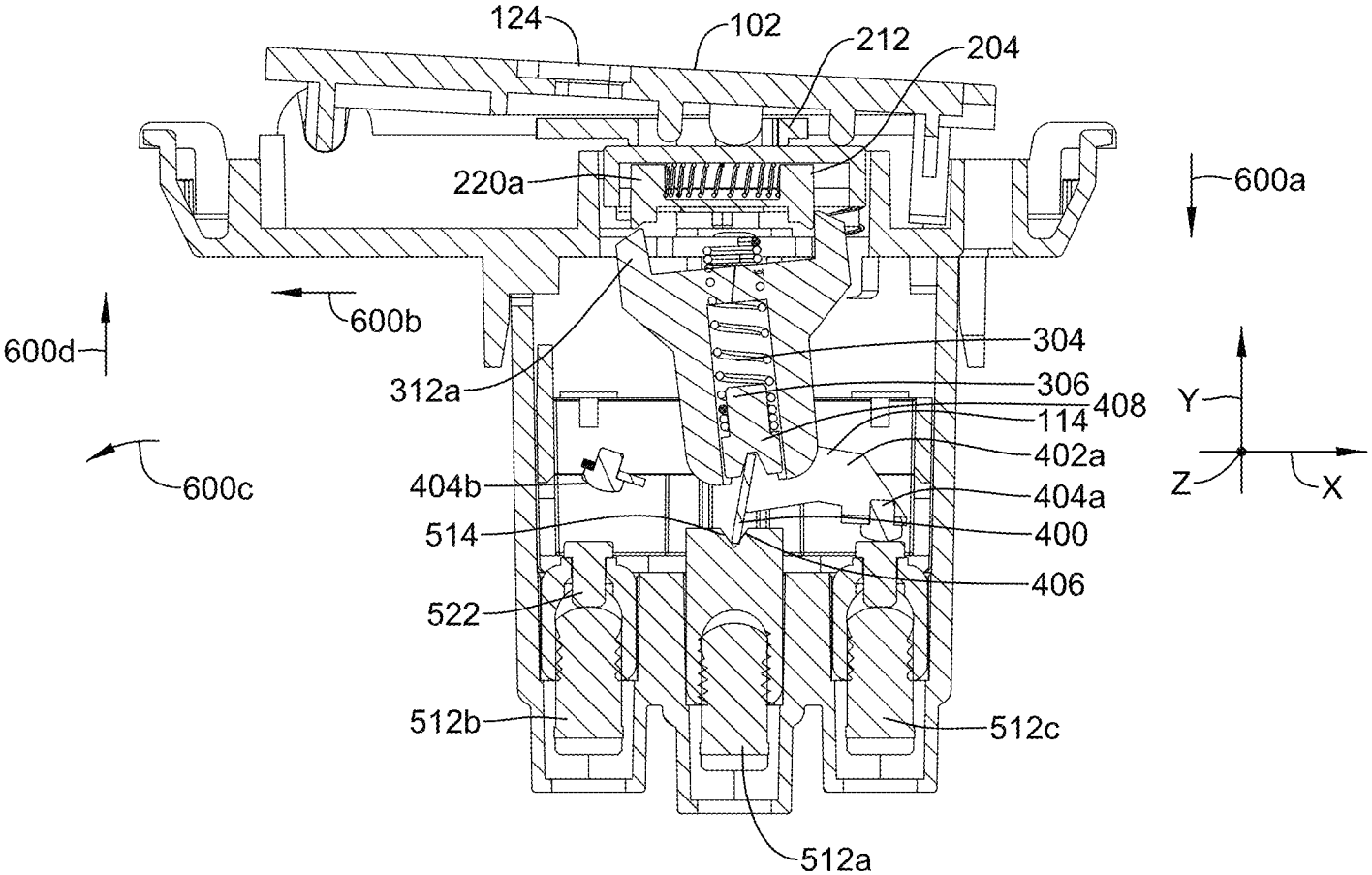

Turning to FIG. 6B, when the push panel 102 is pushed in an inward direction (shown by arrow 600*a*) by a user, the push panel 102 moves from the REST position to an END STOP position against the push panel bias (springs 202 not explicitly shown). In some cases, the push panel 102 may rotate in the inward direction 600*a* about hinge 122 toward the switching mechanism 104. In response, the rocker actuator 110 may move in the inward direction 600*a*. In response to the inward movement of the rocker actuator 110, the first push feature 220*a* of the slideable part 204 may engage and push the first receiving feature 312*a* of the rocker 112 inward. Because the rocker 112 pivots about an axis, the first receiving feature 312*a* of the rocker 112 also moves in a first lateral direction (shown by arrow 600*b*). The slideable part 204 of the rocker actuator 110 thus moves from the NEUTRAL position in the first lateral direction against the lateral bias member 212 to follow first receiving feature 312*a* of the rocker 112. This rocks the rocker 112 from its ON position to its OFF position about its rotation axis (along axis z, perpendicular to the page) as the first receiving feature 312*a* travels along an arc in a first rotation direction (shown by arrow 600*c*) about its rotation axis.

During the rocking of the rocker 112 from its ON position to its OFF position, the switch member bias element 304 of the rocker 112 maintains a bias force to the control region 400 of the conductive switch member 114, keeping the conductive switch member 114 securely in contact with the switch member support 522 of the electrical terminals 118. In the example shown, the switch member support 522 is in electrical contact with the first terminal 512*a* of the electrical terminals 118.

In some cases, the bias force provided during the transition of the conductive switch member 114 between the CLOSED position to the OPEN position may be larger than the bias force that is provided by the switch member bias element 304 when the conductive switch member 114 is at either of the CLOSED or OPEN position. During the transitional (i.e., when the conductive switch member 114 moves between the CLOSED position and the OPEN position), the plunger 302 of the switch member bias element 304 may move against the bias force and toward the rocker 112, and then move back as the conductive switch member 114 moves toward the CLOSED position or OPEN position.

Figure 6C:
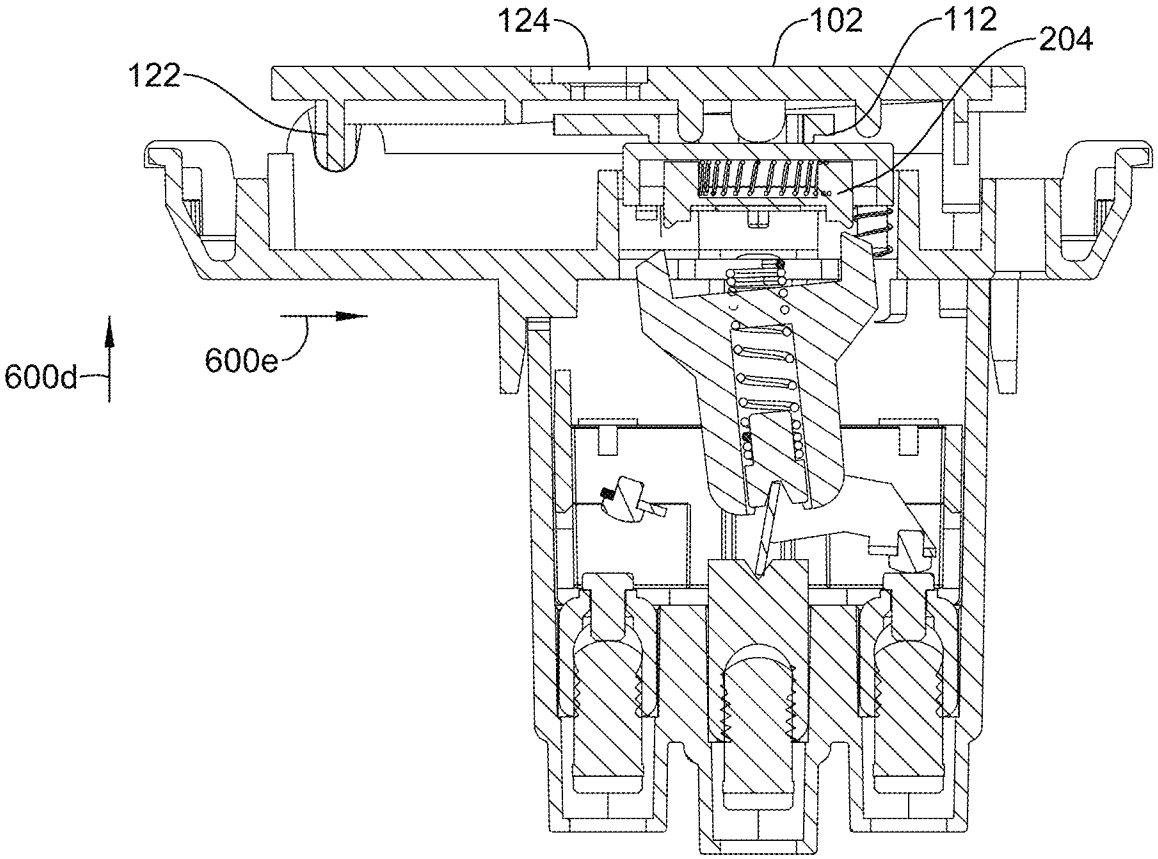

As the rocker 112 toggles the conductive switch member 114, the contact region 402*a* lifts away from the second terminal 512*b* in an outward direction (as shown by arrow 600*d*) toward the push panel 102. As shown in FIGS. 6B-6C, when the conductive switch member 114 is in the OPEN position, the contact region 402*b* no long engages the second terminal 512*b* and the conductive switch member 114 no longer electrically connects the first terminal 512*a* to the second terminal 512*b*. Moreover, in some cases, during the transitional phase, the contact region 402*a* may move toward a third terminal 512*c* in the inward direction 600*a*. As shown in FIG. 6B, when the conductive switch member 114 is in the OPEN or second position, the third terminal 512*c* may face toward the push panel 102 and the contact region 402*a* of the conductive switch member 114 may extend away from the control region 400 and be configured to reach over and engage the third terminal 512*c* as shown. As such, in this example, the electrical contact 404*a* of the contact region 402*a* may contact the third terminal 512*c* and the conductive switch member 114 may electrically connect the first terminal 512*a* to the third terminal 512*c*.

Additionally, in response to the rocking of the rocker 112 from the ON position to the OFF position, the rocker 112 may shift the appendage 130 of the rocker flag 108. The shift in the appendage 130 may move the rocker flag 108 from the VISIBLE position through the aperture 124, as shown in FIG. 6A, to a NON-VISIBLE position where the rocker flag 108 is not visible through the aperture 124, as shown in FIG. 6B.

Turning to FIG. 6C, when the push panel 102 is released by the user in FIG. 6B, the push panel bias (springs 202*a* and 202*b* of rocker actuator 110) may be configured to move the push panel 102 from the END STOP position in the outward direction 600*d* back to the REST position, as shown in FIG. 6C. Moreover, the lateral bias member 212 may be configured to move the slideable part 204 of the rocker actuator 110 in a second lateral direction (as shown by arrow 600*e*), opposite to the first lateral direction 600*b*, back to its NEUTRAL position. As such, in the example depicted in FIG. 6C, the wall switch 100 is in an OFF position. Additionally, the push panel 102 is in the REST position, the rocker flag is in the NON-VISIBLE position through the aperture 124, the slideable part 204 of the rocker actuator 110 is in the NEUTRAL position, the rocker 112 is in the OFF position, and the conductive switch member 114 is in the OPEN or second position.

Figure 6D:
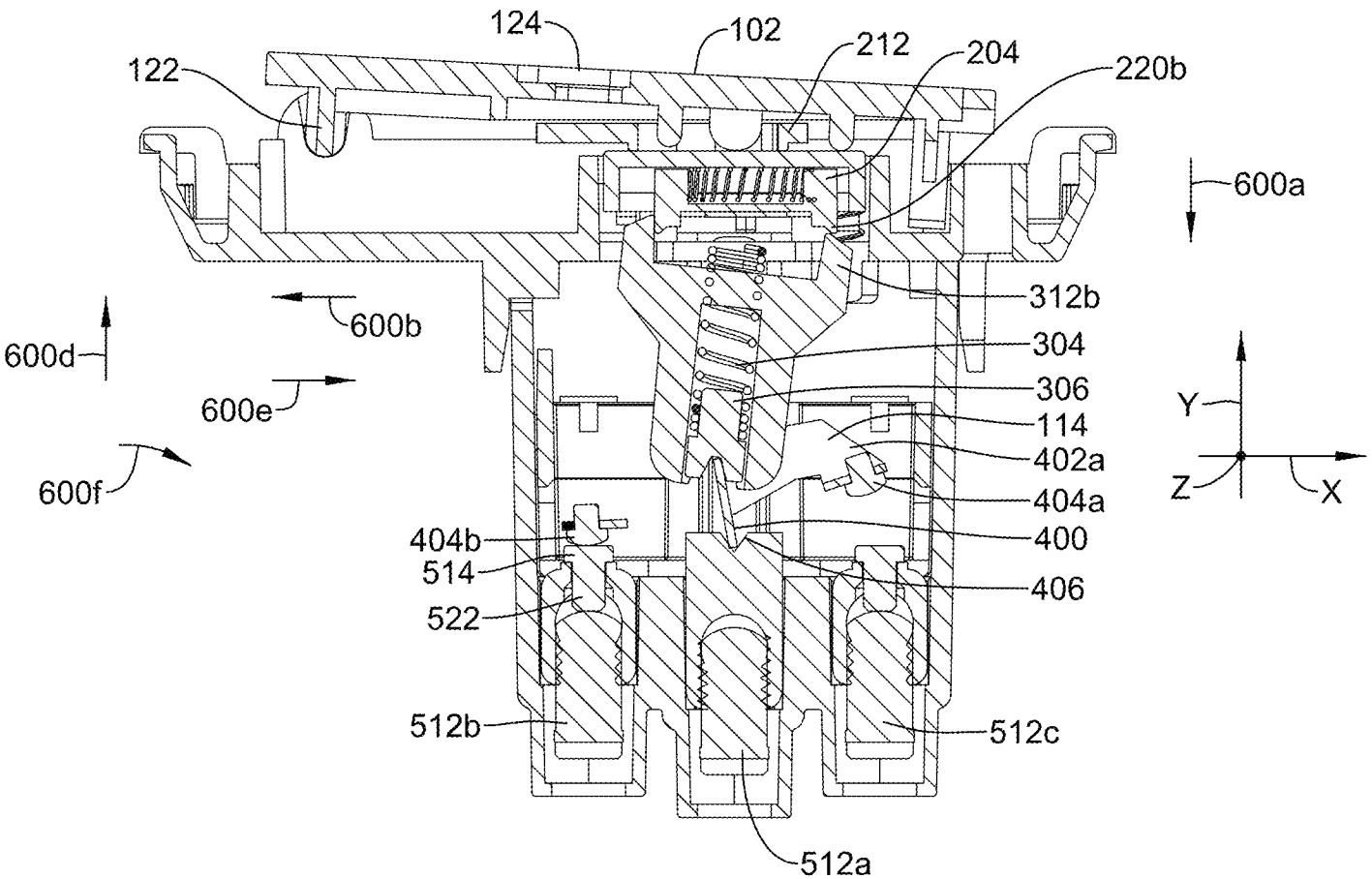

Turning to FIG. 6D, when the push panel 102 is gain pushed in the inward direction 600*a* by the user, the push panel 102 moves from the REST position to the END STOP position against the push panel bias (springs 202*a* and 202*b* of rocker actuator 110). In response, the rocker actuator 110 may move in the inward direction 600*a*. In response to the inward movement of the rocker actuator 110, the second push feature 220*b* of the slideable part 204 may engage and push the second receiving feature 312*b* of the rocker 112 inward. Because the rocker 112 pivots about an axis, the second receiving feature 312*b* of the rocker 112 also moves in a second lateral direction (shown by arrow 600*e*). The slideable part 204 of the rocker actuator 110 thus moves from the NEUTRAL position in the second lateral direction against the lateral bias member 212 to follow second receiving feature 312*b* of the rocker 112. This rocks the rocker 112 from its OFF position to its ON position about its rotation axis (along axis z, perpendicular to the page) as the second receiving feature 312*b* travels along an arc in a second rotation direction (shown by arrow 600*f*) about its rotation axis.

During the rocking of the rocker 112 from its OFF position to its ON position, the switch member bias element 304 of the rocker 112 maintains a bias force to the control region 400 of the conductive switch member 114, keeping the conductive switch member 114 securely in contact with the switch member support 522 of the electrical terminals 118. In the example shown, the switch member support 522 is in electrical contact with the first terminal 512*a* of the electrical terminals 118.

As the rocker 112 toggles the conductive switch member 114, the contact region 404*b* lifts away from the second terminal 512*b* in an outward direction (as shown by arrow 600*d*) toward the push panel 102. When the conductive switch member 114 is in the CLOSED position, the contact region 402*a* no long engages the third terminal 512*c* and the conductive switch member 114 no longer electrically connects the first terminal 512*a* to the third terminal 512*c*. Moreover, in some cases, during the transitional phase, the contact region 404*a* may move toward a second terminal 512*b* in the inward direction 600*a*. As shown in FIG. 6D, when the conductive switch member 114 is in the CLOSED or second position, the second terminal 512*b* may face toward the push panel 102 and the contact region 404*b* of the conductive switch member 114 may extend away from the control region 400 and be configured to reach over and engage the second terminal 512*b* as shown. As such, in this example, the electrical contact 404*b* of the contact region 402*a* may contact the second terminal 512*b* and the conductive switch member 114 may electrically connect the first terminal 512*a* to the second terminal 512*b*.

Additionally, in response to the rocking of the rocker 112 from the OFF position to the ON position, the rocker 112 may shift the appendage 130 of the rocker flag 108. The shift in the appendage 130 may move the rocker flag 108 from the NON-VISIBLE position through the aperture 124, as shown in FIG. 6B-6C, to a VISIBLE position where the rocker flag 108 is visible through the aperture 124, as shown in FIG. 6D.

Although the present system and/or approach has been described with respect to at least one illustrative example, many variations and modifications will become apparent to those skilled in the art upon reading the specification. It is therefore the intention that the appended claims be interpreted as broadly as possible in view of the related art to include all such variations and modifications.

What is claimed is:

1. A switch, comprising:

a first terminal;

a second terminal;

a push panel configured to be pushed inward by a user from a REST position to an END STOP position against a push panel bias, and then return to the REST position under the push panel bias;

a rocker configured to rock between an ON position and an OFF position about a rotation axis;

a rocker actuator configured to actuate the rocker alternately between the ON position and the OFF position each time the push panel is pushed from the REST position to the END STOP position, the rocker actuator is further configured to move in the inward direction when the push panel is pushed inward by the user from the REST position to the END STOP position, and a slidable part of the rocker actuator is also configured to move in a direction lateral to the inward direction against a lateral bias member as the rocker is actuated between the ON position and the OFF position;

a conductive switch member operatively coupled to the rocker and electrically coupled to the first terminal, wherein the rocker is configured to toggle the conductive switch member between a CLOSED position and an OPEN position, wherein the rocker moves the conductive switch member to the CLOSED position when the rocker is moved by the rocker actuator to the ON position of the rocker, and the rocker moves the conductive switch member to the OPEN position when the rocker is moved by the rocker actuator to the OFF position of the rocker;

wherein in the CLOSED position, the conductive switch member connects the first terminal to the second terminal, and in the OPEN position, the conductive switch member does not connect the first terminal to the second terminal;

wherein the slidable part of the rocker actuator includes a first push feature and a second push feature, and wherein the rocker includes a first receiving feature and a second receiving feature, wherein:

when the rocker is in the ON position, and the push panel is pushed inward by the user from the REST position to the END STOP position, the first push feature of the slidable part of the rocker actuator engages and pushes the first receiving feature of the rocker inward, which rocks the rocker from the ON position to the OFF position about the rotation axis with the first push feature moving with the first receiving feature in both the inward direction and in a first direction lateral to the inward direction as the first receiving feature travels along an arc in a first rotation direction about the rotation axis, while the rocker moves the conductive switch member from the CLOSED position to the OPEN position; and when the rocker is in the OFF position, and the push panel is pushed inward by the user from the REST position to the END STOP position, the second push feature of the slidable part of the rocker actuator engages and pushes the second receiving feature of the rocker inward, which rocks the rocker from the OFF position to the ON position about the rotation axis with the second push feature moving with the second receiving feature in both the inward direction and in a second direction lateral to the inward direction as the second receiving feature travels along an arc in a second rotation direction about the rotation axis, while the rocker moves the conductive switch member from the OPEN position to the CLOSED position.

2. The switch of claim 1, wherein the push panel bias is provided by one or more springs, and the lateral bias member comprises one or more springs.

3. The switch of claim 1, wherein the slidable part of the rocker actuator is configured to move in a first lateral direction from a NEUTRAL position against the lateral bias member as the rocker is actuated from the ON position to the OFF position, and to move in a second opposing lateral direction from the NEUTRAL position against the lateral bias member as the rocker is actuated from the OFF position to the ON position.

4. The switch of claim 3, wherein the lateral bias member is configured to return the slidable part of the rocker actuator to the NEUTRAL position each time the push panel returns to the REST position under the push panel bias.

5. The switch of claim 1, further comprising a rocker flag positioned behind the push panel, wherein the rocker is configured to move the rocker flag between a VISIBLE position and a NON-VISIBLE position, wherein the push panel includes an aperture that is positioned such that the rocker flag is visible through the aperture when the rocker flag is in the VISIBLE position and the rocker flag is not visible through the aperture when the rocker flag is in the NON-VISIBLE position.

6. The switch of claim 1, wherein:

the rocker comprises a plunger that includes a switch member bias element;

the conductive switch member comprises a control region and a contact region, wherein the control region is operatively coupled between a plunger of the rocker and a switch member support, wherein the switch member support is electrically coupled to the first terminal; and when the conductive switch member is in the CLOSED position, the contact region of the conductive switch member electrically connects to the second terminal, and when the conductive switch member is in the OPEN position, the contact region of the conductive switch member does not electrically connect to the second terminal.

7. The switch of claim 6, wherein the plunger provides a larger bias force to the control region of the conductive switch member against the switch member support when the conductive switch member is between the CLOSED position and the OPEN position relative to when the conductive switch member is at the CLOSED position or the OPEN position.

8. The switch of claim 1, wherein the push panel bias is provided by one or more springs.

9. A switch, comprising:

a first terminal;

a second terminal;

a push panel configured to be pushed inward by a user from a REST position to an END STOP position against a push panel bias, and then return to the REST position under the push panel bias;

a rocker configured to rock between an ON position and an OFF position;

a rocker actuator configured to actuate the rocker alternately between the ON position and the OFF position each time the push panel is pushed from the REST position to the END STOP position;

the rocker including a switch member bias element;

a conductive switch member comprising a control region and a contact region, wherein the control region is operatively coupled between the switch member bias element of the rocker and a switch member support, wherein the switch member support is electrically coupled to the first terminal;

the rocker is configured to toggle the conductive switch member between a CLOSED position and an OPEN position, wherein the rocker moves the conductive switch member to the CLOSED position when the rocker is moved by the rocker actuator to the ON position of the rocker, and the rocker moves the conductive switch member to the OPEN position when the rocker is moved by the rocker actuator to the OFF position of the rocker, wherein when the conductive switch member is in the CLOSED position, the contact region of the conductive switch member electrically connects to the second terminal, and when the conductive switch member is in the OPEN position, the contact region of the conductive switch member does not electrically connect to the second terminal; and wherein the switch member bias element of the rocker comprises a plunger that engages the control region of the conductive switch member, and the switch member support comprises a recess for receiving a first side of the control region of the conductive switch member, and the plunger comprises a recess for receiving a second side of the control region of the conductive switch member, such that the control region of the conductive switch member pivots about the recess in the switch member support as the rocker toggles the conductive switch member between the CLOSED position and the OPEN position.

10. The switch of claim 9, wherein the switch member bias element provides a larger bias force to the control region of the conductive switch member against the switch member support when the conductive switch member is between the CLOSED position and the OPEN position relative to when the conductive switch member is at the CLOSED position or the OPEN position.

11. The switch of claim 9, further comprising a rocker flag positioned behind the push panel, wherein the rocker is configured to move the rocker flag between a VISIBLE position and a NON-VISIBLE position, wherein the push panel includes an aperture that is positioned such that the rocker flag is visible through the aperture when the rocker flag is in the VISIBLE position and the rocker flag is not visible through the aperture when the rocker flag is in the NON-VISIBLE position.

12. The switch of claim 9, further comprising a third terminal and the conductive switch member comprises a first contact region and a second contact region, wherein when the conductive switch member is in the CLOSED position, the first contact region of the conductive switch member electrically connects to the second terminal and the second contact region of the conductive switch member does not electrically connect to the third terminal, and when the conductive switch member is in the OPEN position, the first contact region of the conductive switch member does not electrically connect to the second terminal and the second contact region of the conductive switch member electrically connect to the third terminal.

13. The switch of claim 9, wherein the second terminal faces toward the push panel and the contact region extends away from the control region and is configured to reach over and engage the second terminal when the conductive switch member is in the CLOSED position.

14. The switch of claim 13, wherein the contact region lifts away from the second terminal in a direction toward the push panel when the conductive switch member is moved from the CLOSED position to the OPEN position.

15. A switch, comprising:

a first terminal;

a second terminal;

a push panel configured to be pushed inward by a user from a REST position to an END STOP position against a push panel bias member, and then return to the REST position under the push panel bias;

a rocker configured to rock between a FIRST position and a SECOND position;

a rocker actuator configured to actuate the rocker alternately between the FIRST position and the SECOND position each time the push panel is pushed from the REST position to the END STOP position, the rocker actuator is further configured to move in the inward direction when the push panel is pushed inward by the user from the REST position to the END STOP position, and a slidable part of the rocker actuator is configured to move in a direction lateral to the inward direction against a lateral bias member as the rocker is actuated between the FIRST position and the SECOND position, wherein the push panel bias member includes a first spring and the lateral bias member includes a second spring that is separate from the first spring;

wherein the lateral bias member biases the slidable part of the rocker actuator toward a NEUTRAL position, and the slidable part of the rocker actuator is configured to move away from the NEUTRAL position in a first direction that is lateral to the inward direction against the lateral bias member as the rocker is actuated from the FIRST position to the SECOND position, and the slidable part of the rocker actuator is configured to move away from the NEUTRAL position in a second direction opposite to the first direction against the lateral bias member as the rocker is actuated from the SECOND position to the FIRST position;

a conductive switch member operatively coupled to the rocker and electrically coupled to the first terminal, wherein the rocker is configured to toggle the conductive switch member between a FIRST position and a SECOND position, wherein the rocker moves the conductive switch member to the FIRST position when the rocker is moved by the rocker actuator to the FIRST position of the rocker, and the rocker moves the conductive switch member to the SECOND position when the rocker is moved by the rocker actuator to the SECOND position of the rocker; and wherein in the FIRST position, the conductive switch member connects the first terminal to the second, and in the SECOND position, the conductive switch member does not connect the first terminal to the second terminal.

16. The switch of claim 15, wherein the conductive switch member comprises a first contact region and a second contact region, wherein in the FIRST position, the first contact region electrically engages the second terminal, and in the SECOND position, the second contact region electrically engages a third terminal.

17. The switch of claim 16, wherein the first contact region lifts away from the second terminal in a direction toward the push panel when the conductive switch member is moved from the FIRST position to the SECOND position, and the second contact region lifts away from the third terminal in a direction toward the push panel when the conductive switch member is moved from the SECOND position to the FIRST position.

18. The switch of claim 15, further comprising a switch member bias element that is configured to bias the rocker against the conductive switch member.

19. The switch of claim 18, the switch member bias element includes a third spring that is separate from the first spring and the second spring.

* * * * *